US009881563B2

(12) United States Patent
Joo et al.

(10) Patent No.: US 9,881,563 B2
(45) Date of Patent: Jan. 30, 2018

(54) LIGHT EMITTING DIODE DRIVER CIRCUIT, DISPLAY APPARATUS INCLUDING THE SAME, AND METHOD FOR DRIVING LIGHT EMITTING DIODE

(71) Applicant: SAMSUNG ELECTRONICS CO., LTD., Suwon-si (KR)

(72) Inventors: Sung-yong Joo, Yongin-si (KR); Jin-hyung Lee, Anyang-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 46 days.

(21) Appl. No.: 14/953,897

(22) Filed: Nov. 30, 2015

(65) Prior Publication Data

US 2016/0351132 A1 Dec. 1, 2016

(30) Foreign Application Priority Data

Jun. 1, 2015 (KR) ..... 10-2015-0077135

(51) Int. Cl.
*G09G 3/36* (2006.01)
*G09G 3/34* (2006.01)
*H05B 39/02* (2006.01)

(52) U.S. Cl.
CPC ..... *G09G 3/3406* (2013.01); *H05B 39/02* (2013.01); *G09G 2320/064* (2013.01); *G09G 2320/0606* (2013.01); *G09G 2320/0646* (2013.01); *G09G 2320/0653* (2013.01); *G09G 2330/021* (2013.01); *G09G 2330/024* (2013.01); *G09G 2330/026* (2013.01)

(58) Field of Classification Search
CPC ..... G09G 3/3406
USPC ..... 345/102
See application file for complete search history.

(56) References Cited

U.S. PATENT DOCUMENTS

2009/0009506 A1* 1/2009 Lee ..... H04N 5/63 345/212
2013/0021326 A1* 1/2013 Tsai ..... G09G 3/32 345/419
2014/0362071 A1* 12/2014 Jung ..... H05B 33/0824 345/212
2015/0181659 A1* 6/2015 Kang ..... H05B 33/0809 315/186
2015/0289325 A1* 10/2015 Szolusha ..... H05B 33/08 315/201

* cited by examiner

*Primary Examiner* — Long D Pham
(74) *Attorney, Agent, or Firm* — Sughrue Mion, PLLC

(57) ABSTRACT

A light emitting diode driver (LED) circuit and method are provided. The light emitting diode driver circuit includes an LED array; a LED driving circuit configured to supply current to the LED array through switching operations of a plurality of switches; and a driving controller configured to control the plurality of switches to supply current, corresponding to a dimming signal, to the LED array using a clock signal of a preset frequency. The driving controller may be further configured to control the plurality of switches to alternately perform switching operations.

16 Claims, 10 Drawing Sheets

LIGHT EMITTING DIODE DRIVER CIRCUIT, DISPLAY APPARATUS INCLUDING THE SAME, AND METHOD FOR DRIVING LIGHT EMITTING DIODE

CROSS-REFERENCE TO RELATED APPLICATION(S)

This application claims priority from Korean Patent Application No. 10-2015-0077135, filed on Jun. 1, 2015, in the Korean Intellectual Property Office, the disclosure of which is incorporated herein by reference in its entirety.

BACKGROUND

1. Field

Apparatuses and methods consistent exemplary embodiments relate to a light emitting diode driver circuit, a display apparatus including the same, and a method for driving a light emitting diode, and more particularly, to a light emitting diode driver circuit capable of minimizing an output ripple, a display apparatus including the same, and a method for driving a light emitting diode.

2. Description of Related Art

Liquid crystal display (LCD) apparatuses are thin, lightweight, and require low driving voltage and power consumption. Therefore, as compared to other types display apparatuses, LCD apparatuses are widely used. However, as LCD panels do not emit light for themselves, LCD apparatuses need a separate backlight for supplying light to the LCD panel.

Cold cathode fluorescent lamps (CCFLs) and light emitting diodes (LEDs) are frequently used as backlights for LCD apparatuses. CCFLs use mercury, which may cause an environmental contamination, have a slow response speed, a low color reproducibility, and are not suitable for lightweight, thin, short, and small LCD panels.

LEDs are much more environment-friendly and provide impulse driving. LEDs have excellent color reproducibility, the amounts of light of red, green, and blue LEDs may be mixed to arbitrarily change brightness, color temperature, etc. and are suitable for lightweight, thin, short, and small LCD panels. Therefore, LEDs have been recently employed as backlight sources.

LCD backlights employing LEDs change current supplied to the LEDs in correspondence to brightness information of an image for the purpose of improvement of image quality and reduction of power consumption.

In a switching converter of the related art, current is supplied to the LEDs in a clock cycle unit within an IC controlling an LED driver circuit. However, in the related art, an output ripple occurs due to a switching operation in an output end.

SUMMARY

Exemplary embodiments overcome the above disadvantages and other disadvantages not described above. Also, one or more of the exemplary embodiments are not required to overcome the disadvantages described above, and an exemplary embodiment may not overcome any of the problems described above.

One or more of the exemplary embodiments provide a light emitting diode driver circuit that alternately switches a plurality of switch devices and minimizes an output ripple, a display apparatus including the same, and a method for driving a light emitting diode.

According to an aspect of an exemplary embodiment, there is provided a light emitting diode (LED) driver circuit including: an LED array; a first LED driving circuit configured to switch a first switch and supply current to the LED array; a second LED driving circuit configured to switch a second switch and provide current to the LED array; and a driving controller configured to control the first switch and the second switch such that the first LED driving circuit and the second LED driving circuit alternately supply current to the LED array.

The driving controller may be further configured to control the first switch and the second switch such that the first LED driving circuit and the second LED driving circuit simultaneously supply current to the LED array for a preset time during an initial startup of the light emitting diode driver circuit.

The driving controller may be further configured to receive a dimming signal, and, in response to a pulse width of the dimming signal being smaller than a threshold value, control one of the first switch and the second switch to maintain a turn-off state.

The first LED driving circuit may include: a power supply configured to supply power; a first inductor having a first end connected to the power supply and a second end connected to a first end of the first switch; a first diode having an anode end commonly connected to the second end of the first inductor and the first end of the first switch, and a cathode end connected to a first end of the LED array; a capacitor having a first end commonly connected to the cathode end of the first diode and the first end of the LED array, and a second end connected to ground; and a first resistor having a first end connected to a second end of the first switch and a second end connected to ground.

The driving controller may be further configured to control the first switch and the second switch to supply current to the LED array in one of a discontinuous current mode (DCM) and a continuous current mode (CCM).

The driving controller may be further configured to control the first switch and the second switch to supply current to the LED array only in the CCM for a preset time during an initial startup of the light emitting diode driver circuit.

Each of the first switch and the second switch may be a metal-oxide-semiconductor field-effect transistor (MOSFET).

According to an aspect of another exemplary embodiment, there is provided a display apparatus including: a liquid crystal display (LCD) panel configured to receive an image signal and display an image; a backlight configured to include a light emitting diode (LED) array and provide light to the LCD panel by controlling a plurality of LED driver circuits, each of which includes a switch, to alternately supply current, corresponding to a dimming signal, to the LED array; and an image signal processor configured to provide the image signal to the LCD panel, generate the dimming signal corresponding to the image signal, and provide the dimming signal to the backlight.

The backlight may be further configured to control the plurality of LED driver circuits to simultaneously supply current to the LED array for a preset time during an initial startup of the display apparatus.

In response to a pulse width of the dimming signal being smaller than a threshold value, the backlight may be further configured to control only one of the plurality of LED driver circuits to operate.

Each of the plurality of LED driver circuits may include: a power supply configured to supply power; a first inductor having a first end connected to the power supply and a second end connected to a first end of the respective switch; a first diode having an anode end commonly connected to the second end of the first inductor and the first end of the respective switch, and a cathode end connected to a first end of the LED array; a capacitor having a first end commonly connected to the cathode end of the first diode and the first end of the LED array, and a second end connected to ground; and a first resistor having a first end connected to a second end of the respective switch and a second end connected to ground.

The backlight may be further configured to control the respective switches to supply current to the LED array in one of a discontinuous current mode (DCM) and a continuous current mode (CCM).

The backlight may be further configured to control the respective switch devices to supply current to the LED array only in the CCM for a preset time during an initial startup of the display apparatus.

Each of the switches may be a metal-oxide-semiconductor field-effect transistor (MOSFET).

According to an aspect of another exemplary embodiment, there is provided a method for driving a light emitting diode (LED) of a light emitting diode driver circuit including an LED array and a plurality of LED driver circuits, the method including: receiving a dimming signal; and alternately supplying current, corresponding to the dimming signal, to the LED array, wherein the supplying is performed by the plurality of LED driver circuits.

The supplying may include simultaneously supplying current to the LED array for a preset time during an initial startup of the light emitting diode driver circuit, wherein the supplying may be performed by the plurality of LED driver circuits.

In response to a pulse width of the dimming signal being smaller than a threshold value, the supplying may include operating only one of the plurality of LED driver circuits.

The supplying may include supplying current to the LED array in one of a discontinuous current mode (DCM) and a continuous current mode (CCM).

The supplying may include supplying current to the LED array only in the CCM for a preset time during an initial startup of the light emitting diode driver circuit.

According to an aspect of another exemplary embodiment, there is provided a light emitting diode (LED) driver circuit including: an LED; a first LED driving circuit including a first inductor and a first switch; a second LED driving circuit including a second inductor and a second switch; a driving controller configured to control the first switch and the second switch such that the first LED driving circuit and the second LED driving circuit provide current to the LED, wherein in a first driving mode during an initial startup of the LED driver circuit, the driving controller is further configured to control the first switch and the second switch such that the first LED driving circuit and the second LED driving circuit simultaneously provide current to the LED, and wherein in a second driving mode after the initial startup of the LED driver circuit, the driving controller is further configured to control the first switch and the second switch such that the first LED driving circuit and the second LED driving circuit alternately provide current to the LED.

The driving controller may be further configured to control each of the first LED driving circuit and the second LED driving circuit to operate in one of a discontinuous current mode (DCM) and a continuous current mode (CCM).

In a low power mode, the driving controller may be further configured to control the first switching device and the second switching device such that only the first LED driving circuit provides current to the LED.

BRIEF DESCRIPTION OF THE DRAWING

The above and/or other aspects will be more apparent by describing certain exemplary embodiments with reference to the accompanying drawings, in which.

DETAILED DESCRIPTION OF THE EXEMPLARY EMBODIMENTS

Figure 1:
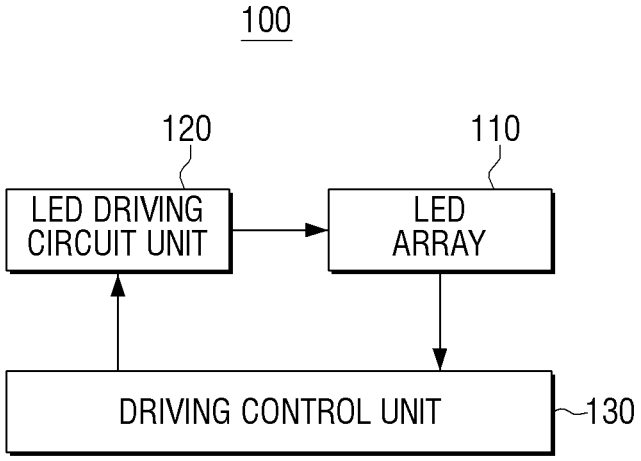
FIG. 1 is a block diagram of a configuration of a light emitting diode driver circuit according to an exemplary embodiment.

Certain exemplary embodiments will now be described in greater detail with reference to the accompanying drawings.

In the following description, the same drawing reference numerals are used for the same elements, even in different drawings. The matters defined in the description, such as the detailed construction and elements, are provided to assist the reader in a comprehensive understanding of the present inventive concept. Thus, it should be apparent that the exemplary embodiments can be carried out without those specifically defined matters. Also, well-known functions or constructions are not described in detail because they would obscure the exemplary embodiments with unnecessary detail.

FIG. 1 is a block diagram of a configuration of a light emitting diode driver circuit 100 according to an exemplary embodiment.

Referring to FIG. 1, the light emitting diode driver circuit 100 includes an LED array 110, an LED driving circuit unit 120 (e.g., an LED driving circuit), and a driving control unit 130 (e.g., a driving controller).

Figure 2:
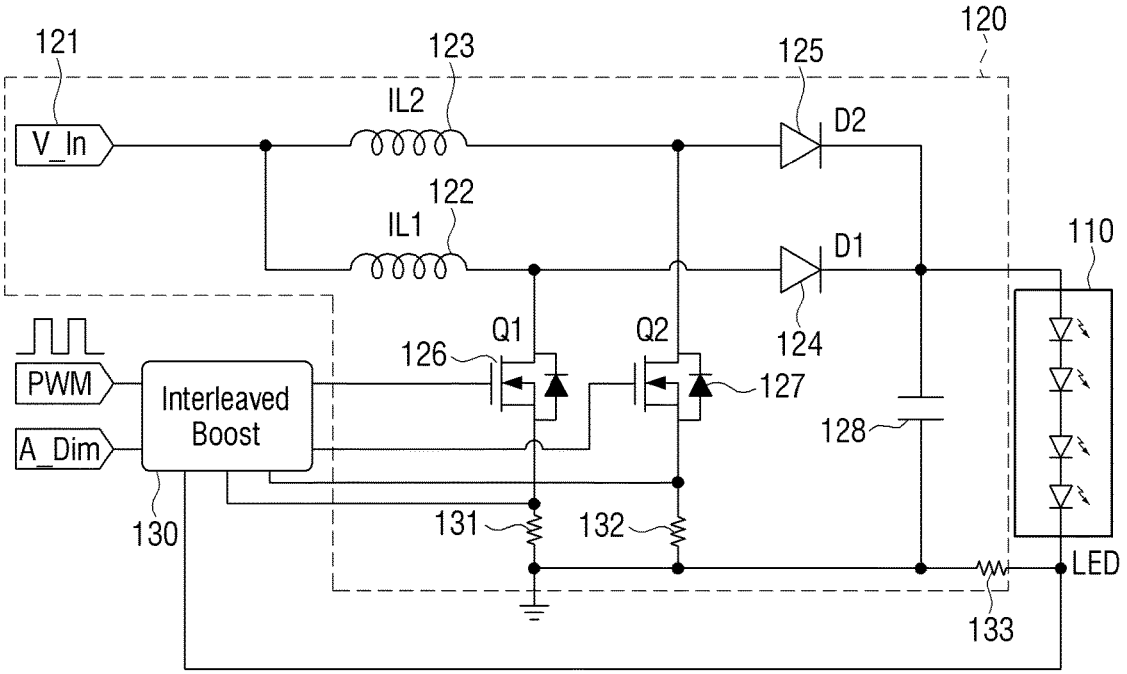
FIG. 2 is a circuit diagram of the light emitting diode driver circuit of FIG. 1.

The LED array 110 may emit light. In more detail, the LED array 110, in which a plurality of light emitting diodes (LEDs) are connected in series to each other, may emit light of brightness corresponding to a size of current provided by the LED driving circuit unit 120. Although only a single LED array 110 is illustrated in FIG. 2, the exemplary embodiments are not limited thereto. For example, a plurality of LED arrays 110 may be disposed in the light emitting diode driver circuit 100 when the LED array 110 is implemented. The plurality of LED arrays 110 may be disposed in various ways such as in series, parallel, or series/parallel. The LED array 110 may also include a single LED.

The LED driving circuit unit 120 may provide substantially constant current to the LED array 110 by a switching operation of a switching device. In more detail, the LED driving circuit unit 120 may provide the constant current to the LED array 110 in an interleaving way. Detailed configuration and operation of the LED driving circuit unit 120 will be described in greater detail below with reference to FIGS. 3 and 5.

The driving control unit 130 may control a plurality of switch devices to allow current corresponding to a dimming signal to be provided to the LED array 110 using a clock signal of a preset frequency. In more detail, the driving control unit 130 may compare current flowing through the LED array 110 and a preset current and control the switch devices of the LED driving circuit unit 120 to switch at a high speed to allow constant current corresponding to the dimming signal to flow through the LED array 110.

The driving control unit 130 may control the plurality of switch devices to perform an alternate switching operation. An alternate switching operation will be described in greater detail below with reference to FIG. 2.

The driving control unit 130 may control the plurality of switch devices to simultaneously perform switching operations during a first time and alternately perform switching operations during a second time. In this regard, the first time may be a startup time of PWM dimming, and the second time may be a driving time of the LED array 110 excluding the startup time of PWM dimming.

When a dimming frequency is equal to or lower than a threshold value, the driving control unit 130 may control only one of the plurality of switch devices to perform a switching operation. For example, in a power saving mode, only one switch device may perform the switching operation, and thus the LED array 110 may reduce power consumption and improve power efficiency.

The driving control unit 130 may control the LED driving circuit unit 120 to operate in a discontinuous current mode (DCM) or a continuous current mode (CCM), according to a driving mode. The DCM refers to a mode in which the current flowing through an inductor arrives a zero point before the corresponding switch device is turned off, while the CCM mode refers to a mode in which the current flowing through the inductor does not arrive the zero point before the corresponding switch device is turned off.

During the first time, the driving control unit 130 may control the LED driving circuit unit 120 to operate in the CCM to reduce the startup time. During the second time, the driving control unit 130 may control the LED driving circuit unit 120 to operate in the CCM or DCM. As set for the above, the first time may be the startup time of PWM dimming, and the second time may be the driving time of the LED array 110 excluding the startup time of PWM dimming.

The driving control unit 130 may be implemented as a digital circuit and/or an analog circuit. When the driving control unit 130 is implemented as the digital circuit, the operations described above may be reflected in an algorithm form. When the driving control unit 130 is implemented as the analog circuit, the driving control unit 130 may be implemented as described with reference to FIG. 2 below.

FIG. 2 is a circuit diagram of the light emitting diode driver circuit 100 of FIG. 1.

Referring to FIG. 2, the light emitting diode driver circuit 100 includes a power unit 121 (e.g., a power supply), a first inductor 122, a second inductor 123, a first diode 124, a second diode 125, a first switch device 126, a second switch device 127, a capacitor 128, a first resistor 131, a second resistor 132, and a third resistor 133.

The power unit 121 may supply power to the LED driving circuit unit 120.

The first inductor 122 may have one end connected to one end of the power unit 121 and another end commonly connected to one end of the first switch device 126 and an anode of the first diode 124.

The second inductor 123 may have one end connected to one end of the power unit 121 and another end commonly connected to one end of the second switch device 127 and an anode of the second diode 125.

The first switch device 126 may perform a switching operation based on a control signal of the driving control unit 130. The first switch device 126 may have one end commonly connected to another end of the first inductor 122 and the anode of the first diode 124. The first switch device 126 may be implemented as a metal-oxide-semiconductor field-effect transistor (MOSFET) for high speed switching.

The second switch device 127 may perform the switching operation based on the control signal of the driving control unit 130. The second switch device 127 may have one end commonly connected to another end of the second inductor 123 and the anode of the second diode 125. The second switch device 127 may be implemented as a MOSFET for high speed switching.

The anode of the first diode 124 may be commonly connected to another end of the first inductor 122 and one end of the first switching device 126 and a cathode thereof may be commonly connected to one end of the capacitor 128 and one end (more particularly, an anode inside the LED array 110) of the LED array 110.

The capacitor 128 may have one end commonly connected to the cathode of the first diode 124, a cathode of the second diode 125, and one end (more particularly, the anode inside the LED array 110) of the LED array 110, and another end connected to ground.

The first resistor 131 may have one end connected to another end of the first switching device 126 and another end connected to ground. In this regard, the first resistor 131 is a sensing resistor for detecting current flowing through the first inductor 122 when the first switching device 126 is turned on.

The second resistor 132 may have one end connected to another end of the second switching device 127 and another end connected to ground. In this regard, the second resistor 132 is a sensing resistor for detecting current flowing through the second inductor 123 when the second switching device 127 is turned on.

The third resistor 133 may have one end connected to another end (more particularly, a cathode inside the LED array 110) of the LED array 110 and another end connected to ground. In this regard, the third resistor 133 is a sensing resistor for detecting current flowing through the LED array 110.

Figure 3:
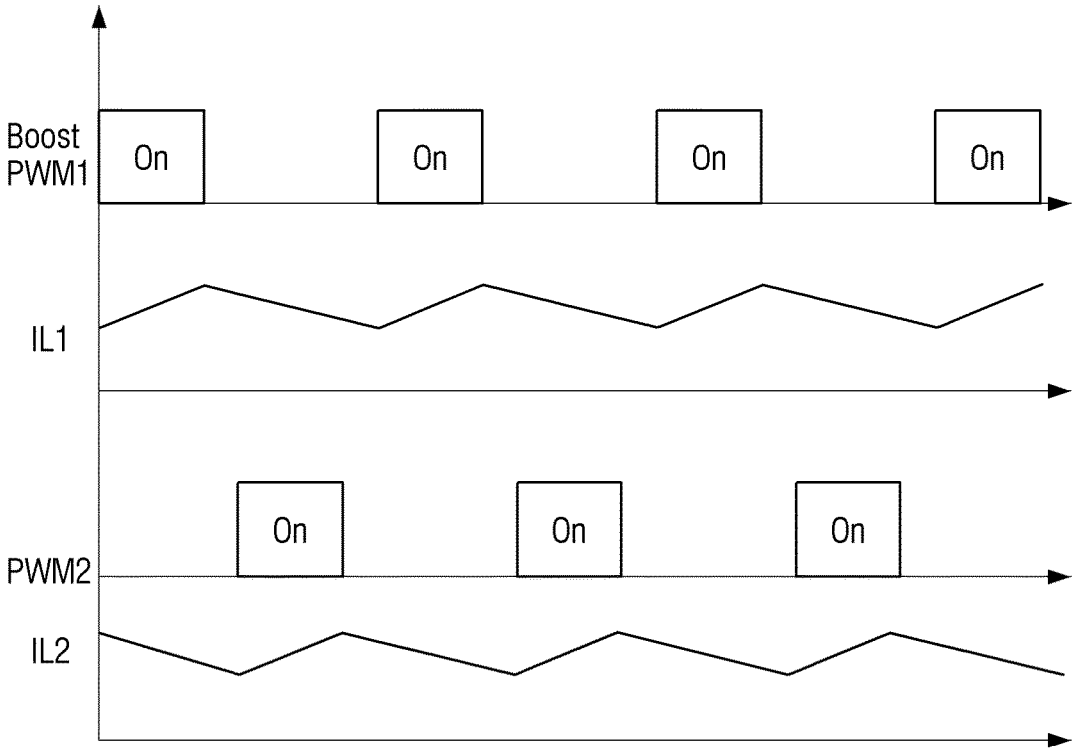
FIGS. 3 and 4 are diagrams illustrating examples of operations of a light emitting diode driver circuit due to alternate switching according to an exemplary embodiment.
Figure 4:
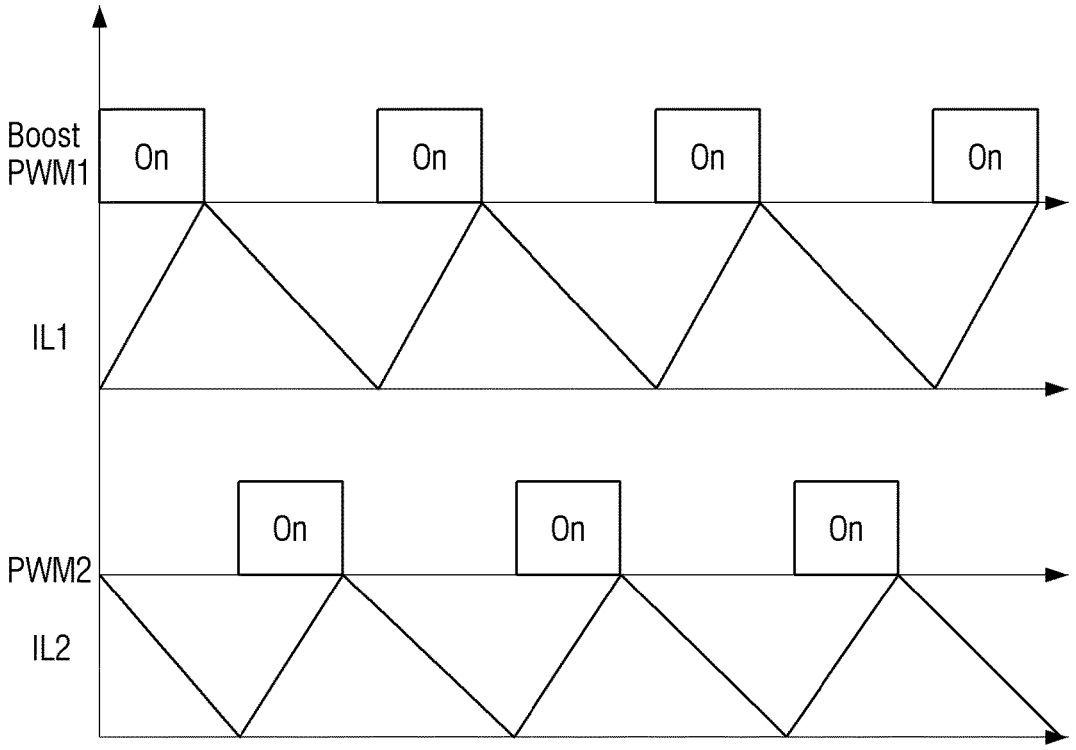

FIGS. 3 and 4 are diagrams illustrating examples of operations of a light emitting diode driver circuit due to alternate switching according to an exemplary embodiment.

Referring to FIG. 3, when the switching devices 126 and 127 are turned on and off, current flowing through the inductors 122 and 123 may respectively increase and decrease. In more detail, if the first switch device 126 is turned off after being turned on, the second switch device 127 may be turned on, and, if the second switch device 127 is turned off after being turned on, the first switch device 126 may be turned on. Through such alternate switching operations, the LED driving circuit unit 120 may provide a certain current to the LED array 110 while minimizing an output ripple of the LED array 110.

The driving control unit 130 may control the LED driving circuit unit 120 in the DCM or CCM. As shown in FIG. 3, when the driving control unit 130 controls the LED driving circuit unit 120 in the CCM, the current flowing through the inductors 122 and 123 is not zero when the switching devices 126 and 127 are turned off.

FIG. 4 is a diagram illustrating an example of a case where the driving control unit 130 controls the LED driving circuit unit 120 in the DCM. Referring to FIG. 4, when the switching devices 126 and 127 are turned off in the DCM, the current flowing through the inductors 122 and 123 is zero.

Figure 5:
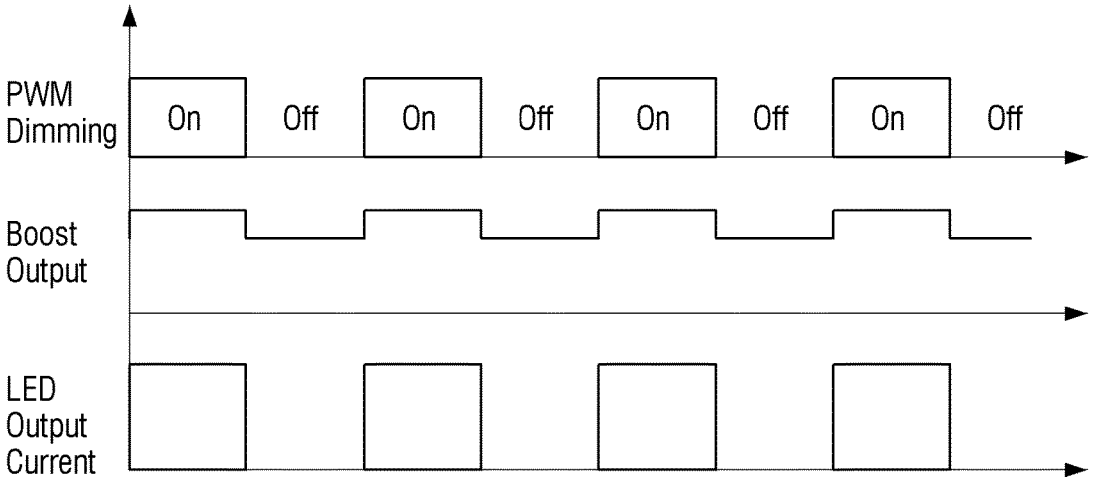
FIG. 5 is a diagram illustrating an example of an LED output current output by pulse width modulation (PWM) dimming according to an exemplary embodiment.

FIG. 5 is a diagram illustrating an example of an LED output current output by PWM dimming according to an exemplary embodiment.

Referring to FIG. 5, if a PWM dimming signal is input in the driving control unit 130, a boost output corresponding to the PWM dimming signal is input in the LED driving circuit unit 120, and LED output current flows in the LED array 110 through a switching operation of the LED driving circuit unit 120.

Figure 6:
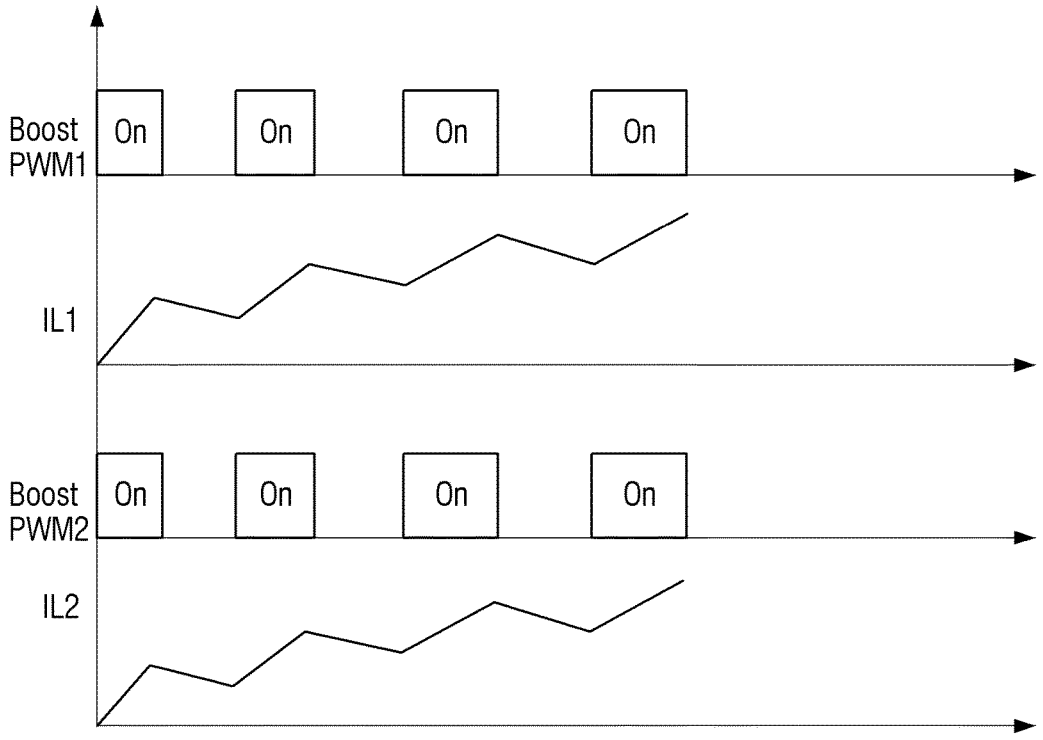
FIG. 6 is a diagram illustrating an example of a switching operation performed during an initial startup period according to an exemplary embodiment.

FIG. 6 is a diagram illustrating an example of a switching operation performed during an initial startup period according to an exemplary embodiment.

Referring to FIG. 6, when the light emitting diode driver circuit 100 initially starts up, the driving control unit 130 may control the switch devices 126 and 127 to be simultaneously turned on and off. In more detail, the driving control unit 130 may increase a driving voltage supplied to the LED array 110 more quickly by simultaneously turning on and off the switch devices 126 and 127. That is, because the driving voltage is required to be more than a certain amount in order to drive the LED array 110, a certain startup time is initially necessary before driving the LED array 110. By simultaneously turning on and off the switch devices 126 and 127 during an initial startup, the driving voltage is quickly increased, thereby reducing a startup time.

The driving control unit 130 may control the switch devices 126 and 127 to be simultaneously turned on and off during the initial startup and control the switch devices 126 and 127 to perform alternate switching operations after the initial startup.

Figure 7:
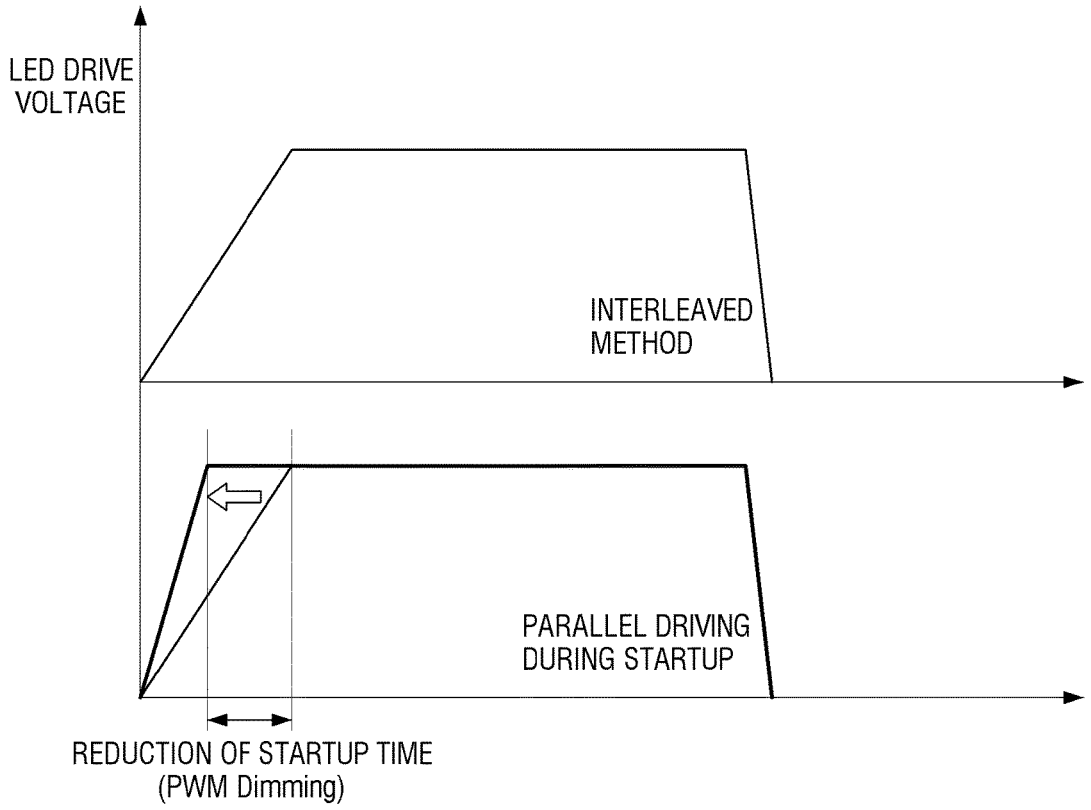
FIG. 7 is a diagram illustrating an example of a startup time reduction due to the switching operation of FIG. 6.

FIG. 7 is a diagram illustrating an example of a startup time reduction due to the switching operation of FIG. 6.

Referring to FIG. 7, the driving control unit 130 may control the switch devices 126 and 127 to be simultaneously turned on and off during an initial startup, thereby quickly increasing a driving voltage provided by the LED array 110. Thus, as illustrated in FIG. 7, the startup time may be reduced (e.g., as compared to alternate switching operations of the switch devices 126 and 127 during initial startup).

Figure 8:
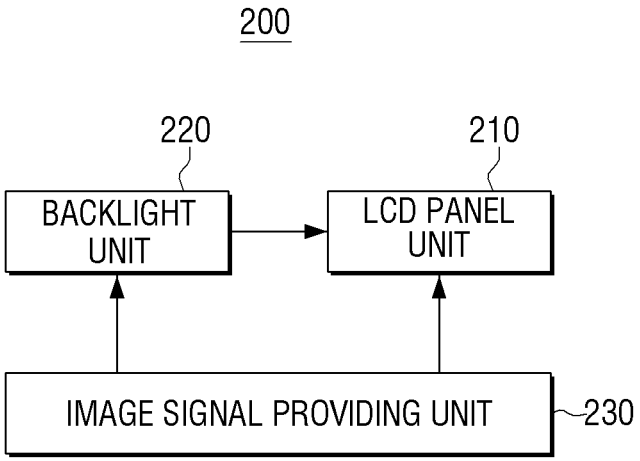
FIG. 8 is a block diagram of a configuration of a display apparatus according to an exemplary embodiment.

FIG. 8 is a block diagram of a configuration of a display apparatus 200 according to an exemplary embodiment.

Referring to FIG. 8, the display apparatus 200 includes an LCD panel unit 210 (e.g., an LED panel), a backlight unit 220 (e.g., a backlight), and an image signal providing unit 230 (e.g., image signal processor).

The LCD panel unit 210 may receive an image signal and display an image. In more detail, the LCD panel unit 210 may be driven by a difference in an electric potential between a pixel electrode and a common electrode. Such a difference in the electric potential may be used to transmit light emitted by the backlight unit 220 through liquid crystal (LC) or adjust a degree of transmittance and display gradation. That is, the LCD panel unit 210 may adjust the LC according to the image signal provided by the image signal providing unit 230 and display the image.

The image signal providing unit 230 may provide the image signal to the LCD panel unit 210. In more detail, the image signal providing unit 230 may provide image data and/or various image signals for displaying the image data to the LCD panel unit 210.

The image signal providing unit 230 may extract brightness information corresponding to the image signal and generate a dimming signal corresponding to the extracted brightness information. The image signal providing unit 230 may provide the generated dimming signal to the backlight unit 220. The dimming signal may be a PWM signal.

The backlight unit 220 may emit light to the LCD panel unit 210. In more detail, the backlight unit 220 may include an LED array and provide constant current corresponding to the dimming signal to the LED array to provide light of brightness corresponding to the dimming signal to the LCD panel unit 210. The backlight unit 220 may be referred to as an LED driving apparatus or an LED driving circuit.

The backlight unit 220 may use a plurality of switch devices to control the constant current provided to the LED array.

Figure 9:
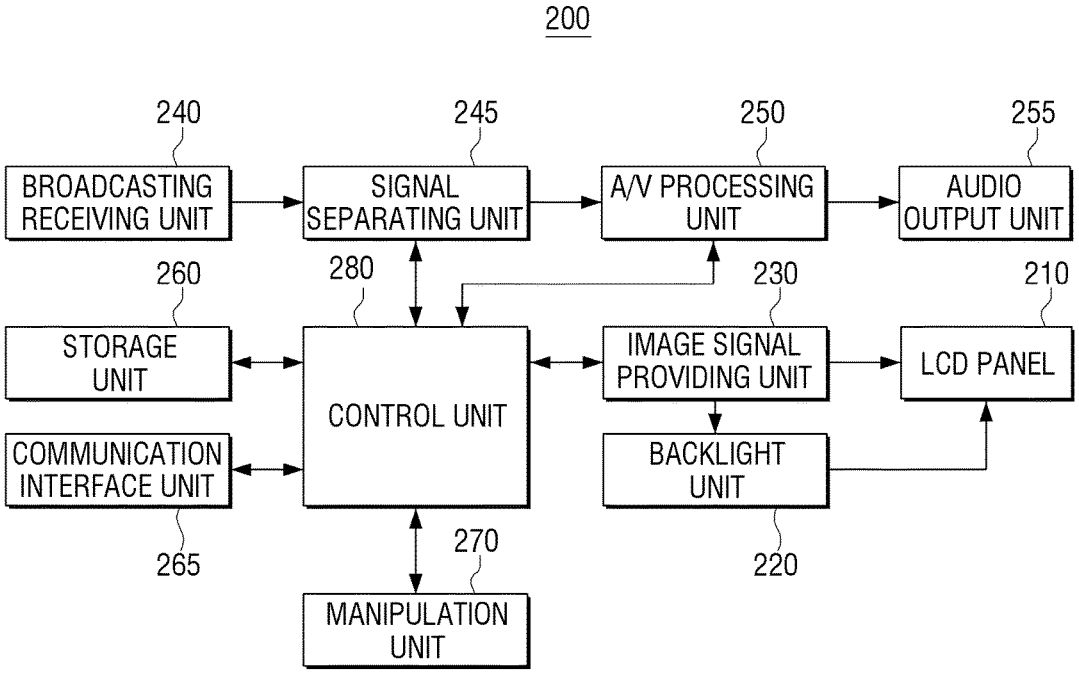
FIG. 9 is a block diagram of a detailed configuration of a display apparatus according to an exemplary embodiment.

Although a brief configuration of the display apparatus 200 is described above, the display apparatus 200 may include the configuration shown in FIG. 9. A detailed configuration of the display apparatus 200 will be described in greater detail below with reference to FIG. 9.

FIG. 9 is a block diagram of a detailed configuration of the display apparatus 200 according to an exemplary embodiment.

Referring to FIG. 9, the display apparatus 200 according to the present exemplary embodiment includes the LCD panel unit 210, the backlight unit 220, the image signal providing unit 230, a broadcasting receiving unit 240 (e.g., a broadcasting receiver), a signal separating unit 245 (e.g., a signal processor), an audio/video (A/V) processing unit 250 (e.g., an A/V processor), an audio output unit 255 (e.g., a speaker), a storage unit 260 (e.g., a storage), a communication interface unit 265 (e.g., a communication interface), a manipulation unit 270 (e.g., a manipulation interface), and a control unit 280 (e.g., a controller).

Operations of the LCD panel unit 210 and the backlight unit 220 have already been described with reference to FIG. 8, and thus redundant descriptions are omitted.

The broadcasting receiving unit 240 may receive and demodulate a broadcasting signal received from a broadcasting station or a satellite by wired or wirelessly.

The signal separating unit 245 may separate a received broadcasting signal into an image signal, an audio signal, and an additional information signal. The signal separating unit 245 may transmit the separated image signal and audio signal to the A/V processing unit 250.

The A/V processing unit 250 may perform signal processing of video decoding, video scaling, audio decoding, etc. on the image signal and audio signal transmitted from the broadcasting receiving unit 240 and the storage unit 260. The A/V processing unit 250 may output the image signal to the image signal providing unit 230 and the audio signal to the audio output unit 255.

When the received image and audio signals are stored in the storage unit 260, the A/V processing unit 250 may output an image and audio to the storage unit 260 in a compressed form.

The audio output unit 255 may convert the audio signal output by the A/V processing unit 250 to output sound via a speaker or via an external device connected through an external output terminal.

The image signal providing unit 230 may generate a graphic user interface (GUI) to be provided to a user. The image signal providing unit 230 may add the GUI to the image output by the A/V processing unit 250. The image signal providing unit 230 may provide an image signal corresponding to the image to which the GUI is added, to the LCD panel unit 210. Accordingly, the LCD panel unit 210 may display various pieces of information provided by the display apparatus 200 and the image transmitted from the image signal providing unit 230.

The image signal providing unit 230 may generate brightness information corresponding to the image signal provided by the LCD panel unit 210 and generate a dimming signal corresponding to the generated brightness information. The dimming signal may be a PWM signal having a preset frequency and a duty ratio varying according to a brightness value.

The image signal providing unit 230 may provide the generated dimming signal to the backlight unit 220. Although it is described above that the image signal providing unit 230 generates the dimming signal with respect to the backlight unit 220, the LCD panel unit 210 may generate the dimming signal and provide the dimming signal to the backlight unit 220 when implemented.

The storage unit 260 may store image content. In more detail, the storage unit 260 may receive and store the image content in which the image and the audio are compressed from the A/V processing unit 250 and output the stored image content to the A/V processing unit 250 according to the control of the control unit 280. The storage unit 260 may be implemented as a hard disk, non-volatile memory, volatile memory, etc.

The manipulation unit 270 may be implemented as a touch screen, a touch pad, a key button, a key pad, etc. and provide a an interface for a user to control the display apparatus 200. Although an example of receiving a control instruction through the manipulation unit 270 included in the display apparatus 200 is described in the present exemplary embodiment, the manipulation unit 270 may receive the user manipulation from an external control apparatus (e.g., a remote controller). That is, the control instruction may be received through the communication interface unit 265 that will be described below.

The communication interface unit 265 may be formed to connect the display apparatus 200 to an external apparatus and may be connected to the external device via a universal serial bus (USB) port as well as via a local area network (LAN) and the Internet. If the image content may be transmitted and received through the communication interface unit 265, the control instruction for controlling the display apparatus 200 may also be received.

The control unit 280 may control overall operations of the display apparatus 200. In more detail, the control unit 280 may control the LCD panel unit 210, the image signal providing unit 230, and the backlight unit 220 to display an image according to the control instruction received through the manipulation unit 270.

The display apparatus 200 according to the present exemplary embodiment described above may vary a frequency of a clock signal inside the backlight unit 220 according to a transition of a value of a dimming signal, thereby minimizing a time difference between a time when the dimming signal is applied and a time when an LED driver circuit operates. Accordingly, the same constant current may be provided to a light emitting diode at every cycle of the dimming signal. In particular, when a dimming duty of the dimming signal is low, that is, when gradation of low brightness is expressed, a brightness difference may remain the same.

Although the function described above is applied to only the display apparatus 200 that receives and displays broadcasting is described with reference to FIG. 2 above, a light emitting diode driver circuit may be applied to any electronic apparatuses including an LCD panel.

Further, although it is described above that the backlight unit 220 is a configuration included in the display apparatus 200, a function of the backlight unit 220 may be implemented as a separate apparatus.

Figure 10:
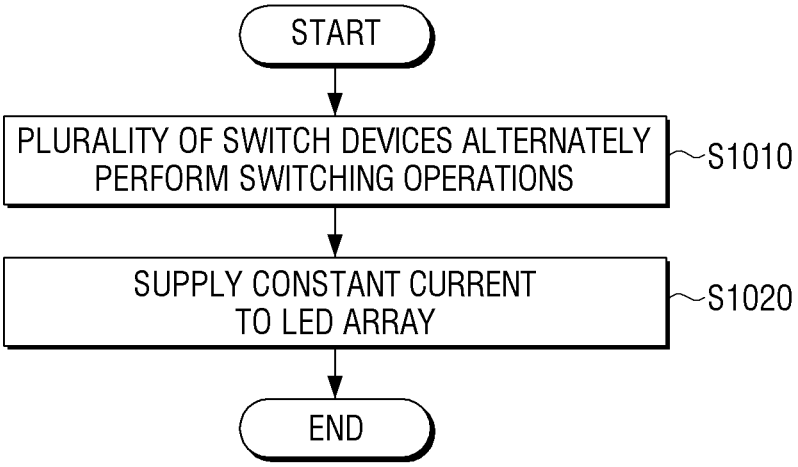
FIG. 10 is a flowchart of a method for driving a light emitting diode according to an exemplary embodiment.

FIG. 10 is a flowchart of a method for driving a light emitting diode according to an exemplary embodiment.

Referring to FIG. 10, first, a plurality of switch devices may alternately perform switching operations (S1010). Constant current may be supplied to an LED array by the switching operations of the plurality of switch devices (S1020). In more detail, if one of the plurality of switch devices is turned off after being turned on, the other switch devices may be turned on, and, if the other switch devices are turned off after being turned on, the one switch device may be turned on.

Therefore, the method for driving the light emitting diode according to an exemplary embodiment may supply current to the LED array by alternate switching operations, thereby supplying a certain current to the LED array by minimizing an output ripple of the LED array. The method for driving the light emitting diode of FIG. 10 may be performed by a light emitting diode driver circuit including the configuration of FIG. 1 or a display apparatus including the configuration of FIG. 8, and may also be performed in a display apparatus, an LED driver circuit, and a control IC including other configurations.

As described above, according to one or more exemplary embodiments, switching operations of first and second switch devices may reduce an initial startup time of PWM dimming while minimizing an output ripple.

In addition, the exemplary embodiments may also be implemented through computer-readable code and/or instructions on a medium, e.g., a non-transitory computer-readable medium, to control at least one processing element to implement any above-described embodiments. The medium may correspond to any medium or media which may serve as a storage and/or perform transmission of the computer-readable code.

The computer-readable code may be recorded and/or transferred on a medium in a variety of ways, and examples of the medium include recording media, such as magnetic storage media (e.g., ROM, floppy disks, hard disks, etc.) and optical recording media (e.g., compact disc read only memories (CD-ROMs) or digital versatile discs (DVDs)), and transmission media such as Internet transmission media. Thus, the medium may have a structure suitable for storing or carrying a signal or information, such as a device carrying a bitstream according to one or more exemplary embodiments. The medium may also be on a distributed network, so that the computer-readable code is stored and/or transferred on the medium and executed in a distributed fashion. Furthermore, the processing element may include a processor or a computer processor, and the processing element may be distributed and/or included in a single device.

The foregoing exemplary embodiments and advantages are merely exemplary and are not to be construed as limiting. The present teaching can be readily applied to other types of apparatuses. Also, the description of the exemplary embodiments of the present inventive concept is intended to be illustrative only, and not to limit the scope of the claims, and many alternatives, modifications, and variations will be apparent to those skilled in the art.

What is claimed is:

1. A light emitting diode (LED) driver circuit comprising:

an LED array;

a first LED driving circuit configured to switch a first switch to supply current to the LED array;

a second LED driving circuit configured to switch a second switch to supply current to the LED array; and a driving controller configured to:

when the first switch is turned off after being turned on, control the second LED driving circuit to turn on the second switch and when the turned-on second switch is turned off after being turned on, control the first LED driving circuit to turn on the turned-off first switch, wherein the first LED driving circuit is configured to supply current to the LED array in response to the first switch being turned on and not to supply current to the LED array in response to the first switch being turned off, wherein the second LED driving circuit is configured to supply current to the LED array in response to the second switch being turned on and not to supply current to the LED array in response to the second switch being turned off, wherein the driving controller is further configured to control the first switch and the second switch to supply current to the LED array in one of a discontinuous current mode (DCM) and a continuous current mode (CCM), wherein the DCM is a mode in which a current flowing through a first inductor of the first LED driving circuit reaches zero before the first switch is turned off and a current flowing through a second inductor of the second LED driving circuit reaches zero before the second switch is turned off, and wherein the CCM is a mode in which the current flowing through the first inductor does not reach zero before the first switch is turned off and the current flowing through the second inductor does not reach zero before the second switch is turned off.

2. The LED driver circuit as claimed in claim 1, wherein the driving controller is further configured to control the first switch and the second switch such that the first LED driving circuit and the second LED driving circuit simultaneously supply current to the LED array for a preset time during an initial startup of the LED driver circuit.

3. The LED driver circuit as claimed in claim 1, wherein the driving controller is further configured to receive a dimming signal, and, in response to a pulse width of the dimming signal being smaller than a threshold value, control one of the first switch and the second switch to maintain a turn-off state.

4. The LED driver circuit as claimed in claim 1, wherein the first LED driving circuit includes:

a power supply configured to supply power;

a first inductor having a first end connected to the power supply and a second end connected to a first end of the first switch;

a first diode having an anode end commonly connected to the second end of the first inductor and the first end of the first switch, and a cathode end connected to a first end of the LED array;

a capacitor having a first end commonly connected to the cathode end of the first diode and the first end of the LED array, and a second end connected to ground; and a first resistor having a first end connected to a second end of the first switch and a second end connected to ground.

5. The LED driver circuit as claimed in claim 1, wherein the driving controller is further configured to control the first switch and the second switch to supply current to the LED array only in the CCM for a preset time during an initial startup of the LED driver circuit.

6. The LED driver circuit as claimed in claim 1, wherein each of the first switch and the second switch is a metal-oxide-semiconductor field-effect transistor (MOSFET).

7. A display apparatus comprising:

a liquid crystal display (LCD) panel configured to receive an image signal and display an image;

a backlight configured to include a light emitting diode (LED) array and provide light to the LCD panel by controlling a first LED driving circuit including a first switch and a second LED driving circuit including a second switch, to alternately supply current, corresponding to a dimming signal, to the LED array; and an image signal processor configured to provide the image signal to the LCD panel, generate the dimming signal corresponding to the image signal, and provide the dimming signal to the backlight, wherein the backlight is further configured to:

when the first switch is turned off after being turned on, control the second LED driving circuit to turn on the second switch and when the turned-on second switch is turned off after being turned on, control the first LED driving circuit to turn on the turned-off first switch, wherein the first LED driving circuit is configured to supply current to the LED array in response to the first switch being turned on and not to supply current to the LED array in response to the first switch being turned off, wherein the second LED driving circuit is configured to supply current to the LED array in response to the second switch being turned on and not to supply current to the LED array in response to the second switch being turned off, wherein the backlight is further configured to control the first switch and the second switch to supply current to the LED array in one of a discontinuous current mode (DCM) and a continuous current mode (CCM), wherein the DCM is a mode in which a current flowing through a first inductor of the first LED driving circuit reaches zero before the first switch is turned off and a current flowing through a second inductor of the second LED driving circuit reaches zero before the second switch is turned off, and wherein the CCM is a mode in which the current flowing through the first inductor does not reach zero before the first switch is turned off and the current flowing through the second inductor does not reach zero before the second switch is turned off.

8. The display apparatus as claimed in claim 7, wherein the backlight is further configured to control the first LED driving circuit and the second LED driving circuit to simultaneously supply current to the LED array for a preset time during an initial startup of the display apparatus.

9. The display apparatus as claimed in claim 7, wherein, in response to a pulse width of the dimming signal being smaller than a threshold value, the backlight is further configured to control only one of the first LED driving circuit and the second LED driving circuit to operate.

10. The display apparatus as claimed in claim 7, wherein each of the first LED driving circuit and the second LED driving circuit further include:

a power supply configured to supply power;

a first inductor having a first end connected to the power supply and a second end connected to a first end of the respective switch;

a first diode having an anode end commonly connected to the second end of the first inductor and the first end of the respective switch, and a cathode end connected to a first end of the LED array;

a capacitor having a first end commonly connected to the cathode end of the first diode and the first end of the LED array, and a second end connected to ground; and a first resistor having a first end connected to a second end of the respective switch and a second end connected to ground.

11. The display apparatus as claimed in claim 7, wherein the backlight is further configured to control the first switch and the second switch to supply current to the LED array only in the CCM for a preset time during an initial startup of the display apparatus.

12. The display apparatus as claimed in claim 7, wherein each of the first switch and the second switch is a metal-oxide-semiconductor field-effect transistor (MOSFET).

13. A method for driving a light emitting diode (LED) of an LED driver circuit including an LED array and a first LED driving circuit including a first switch to supply current to the LED array and a second LED driving circuit including a second switch to supply current to the LED array, the method comprising:

receiving a dimming signal; and alternately supplying current, corresponding to the dimming signal, to the LED array, wherein the supplying is performed by the first LED driving circuit and the second LED driving circuit, wherein the supplying comprises:

when the first switch is turned off after being turned on, controlling the second LED driving circuit to turn on the second switch and when the turned-on second switch is turned off after being turned on, controlling the first LED driving circuit to turn on the turned-off first switch, wherein the first LED driving circuit is configured to supply current to the LED array in response to the first switch being turned on and not to supply current to the LED array in response to the first switch being turned off, and wherein the second LED driving circuit is configured to supply current to the LED array in response to the second switch being turned on and not to supply current to the LED array in response to the second switch being turned off, wherein the supplying includes supplying current to the LED array in one of a discontinuous current mode (DCM) and a continuous current mode (CCM), wherein the DCM is a mode in which a current flowing through a first inductor of the first LED driving circuit reaches a zero before the first switch is turned off and a current flowing through a second inductor of the second LED driving circuit reaches zero before the second switch is turned off, and wherein the CCM is a mode in which the current flowing through the first inductor does not reach zero before the first switch is turned off and the current flowing through the second inductor does not reach zero before the second switch is turned off.

14. The method as claimed in claim 13, wherein the supplying includes simultaneously supplying current to the LED array for a preset time during an initial startup of the LED driver circuit, wherein the supplying is performed by the first LED driving circuit and the second LED driving circuit.

15. The method as claimed in claim 13, wherein in response to a pulse width of the dimming signal being smaller than a threshold value, the supplying includes operating only one of the first LED driving circuit and the second LED driving circuit.

16. The method as claimed in claim 13, wherein the supplying includes supplying current to the LED array only in the CCM for a preset time during an initial startup of the LED driver circuit.

* * * * *